US007283776B2

(12) United States Patent
Oba

(10) Patent No.: US 7,283,776 B2
(45) Date of Patent: Oct. 16, 2007

(54) IMAGE FORMING APPARATUS

(75) Inventor: Katsuhiko Oba, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/252,733

(22) Filed: Oct. 19, 2005

(65) Prior Publication Data

US 2006/0093420 A1 May 4, 2006

(30) Foreign Application Priority Data

Oct. 29, 2004 (JP) ..... 2004-315836

(51) Int. Cl.
*G03G 15/00* (2006.01)
*B41J 2/01* (2006.01)

(52) U.S. Cl. ..... 399/304; 347/102

(58) Field of Classification Search ..... 399/405; 347/104, 102

See application file for complete search history.

(56) References Cited

U.S. PATENT DOCUMENTS 6,042,228 A * 3/2000 Yamada et al. ..... 347/104
6,522,841 B2 2/2003 Horikoshi ..... 399/45
6,788,905 B2 * 9/2004 Tsutada ..... 399/45
2002/0036682 A1 * 3/2002 Johnson ..... 347/104
2004/0188922 A1 9/2004 Takahashi et al. ..... 271/145
2004/0247349 A1 12/2004 Takahashi et al. ..... 399/314
2006/0228139 A1 * 10/2006 Suzuki ..... 399/405

FOREIGN PATENT DOCUMENTS

JP 09-204033 A * 8/1997
JP 2003-208043 7/2003
JP 2004-315229 11/2004
JP 2004-315230 11/2004

* cited by examiner

*Primary Examiner*—Michael Cygan
*Assistant Examiner*—Jonathan Dunlap
(74) *Attorney, Agent, or Firm*—Fitzpatrick, Cella, Harper & Scinto

(57) ABSTRACT

The image forming apparatus includes a fixing device for heat fixing a toner image on a recording material, a discharge device for discharging the recording material on which the toner image is fixed by the fixing device; a blowing device for blowing air onto a lower surface of the recording material discharged by the discharge device; and a control device for controlling an amount of air blow from the blowing device in accordance with a position of the recording material discharged by the discharge device. Thus, it is possible to improve stacking alignment of the recording material while maintaining conveyance property of the recording material in a recording material sheet discharging section.

17 Claims, 13 Drawing Sheets

IMAGE FORMING APPARATUS

BACKGROUND OF THE INVENTION

1. Field of the Invention

The present invention relates to an image forming apparatus such as a copying machine or a printer which employs an electrostatic recording process, an electrophotographic recording process, and the like. More specifically, the present invention relates to an image forming apparatus in which air is blown onto a lower surface of a recording material when the recording material on which a toner image is heat fixed is discharged.

2. Related Background Art

Conventionally, there is known an image forming apparatus in which the recording material is cooled immediately after passing through a conveyance roller in order to prevent a malfunction from occurring in the image forming apparatus due to heat applied to the recording material which has been subjected to heat fixing by a fixing unit.

In FIG. 11, the image forming apparatus of this kind is shown. As shown in FIG. 11, a recording material S on which a toner image is fixed by a fixing unit 300 and whose temperature is high is discharged to a sheet discharging section 150 after passing through a pair of conveyance rollers 130 and 140, and the recording material S receives the air from a blowing unit 200 immediately after passing through the pair of conveyance rollers 130 and 140.

As a result, it is possible to cool the recording material S, making it possible to prevent plastic films such as overhead transparency (OHT) sheets from adhering to one another in the sheet discharging section 150 due to high temperature. Further, by cooling the recording material S, it is possible to prevent such an adverse affect that the temperature of the sheet discharging section 150 is raised so high to adversely affect the temperature inside an image forming apparatus 500. Further, in a case where the image forming apparatus 500 is capable of forming an image on both sides of the recording material S, it is possible to cool the both sides of the recording material S one side at a time, thereby making it possible to prevent the temperature inside the image forming apparatus 500 from rising and to form a high quality image on the recording material S.

Incidentally, there is a case where the entire recording material S is curled in the sheet discharging section 150 to be turned over when the recording material S is discharged from the pair of conveyance rollers 130 and 140. In order to prevent this, a configuration can be thought in which the conveyance roller 130 and the conveyance roller 140 are disposed alternately as shown in FIG. 12 to add stiffness to the recording material S by making the recording material S to be rippled, thereby discharging the recording material S straight.

However, in this case, when the air from the blowing unit 200 is blown onto the recording material S being conveyed, it is possible to lower the temperature of the recording material S, however, there occurs such a phenomenon that the recording material outputted finally is slightly rippled. This phenomenon is especially remarkable in a case of the recording material made of plastic film such as an OHT sheet. This is deemed to occur because the OHT sheet rippled at the high temperature is cooled as it is to remain in the rippled shape.

In this regard, in order to solve the problem of the rippling, there are disposed through rollers of the pair of conveyance rollers which are straight and continuous in a longitudinal direction. Further, in order to prevent the above-mentioned curl (turning over) of the recording material in the sheet discharging, a blowing unit is disposed by which it is possible to bring the recording material upward to convey the recording material by the air blown from the blowing unit.

As a result, it is possible to prevent the rippling and curl of the recording material at the same time.

However, in the above image forming apparatus, stacking capability of the recording material is slightly deteriorated because the air in an amount large enough to bring the recording material being conveyed upward is always blown onto the recording material, although it is a minor problem. This is because the air may impart too much ascending force to the recording material. More specifically, as shown in FIG. 13A, when a trailing edge of the recording material passes through a pair of conveyance rollers 131 and 141 and falls into the sheet discharging section due to a dead weight of the recording material, the air from the blowing unit serves as a resistance, so a falling movement of the trailing edge of the recording material is not stabled. As a result, as shown in FIG. 13B, stacking alignment and stacking capability of the recording material are deteriorated.

Further, depending on a kind of the recording material, the leading edge portion of the recording material is cooled and solidified in a state where the leading edge portion of the recording material is suspended from the pair of conveyance rollers 131 and 141, thereby causing the curl in the leading edge portion of the recording material.

In addition, when the stiffness of the recording material is varied in accordance with the environment, conveyance capability of the recording material may be deteriorated.

SUMMARY OF THE INVENTION

The present invention has an object to provide an image forming apparatus capable of improving stacking alignment of the recording material while maintaining conveyance property of the recording material in a recording material discharging section.

Another object of the present invention is to provide an image forming apparatus including: a fixing device for heat fixing a toner image on a recording material; a discharge device for discharging the recording material on which the toner image is fixed by the fixing device; a blowing device for blowing air onto a lower surface of the recording material discharged by the discharge device; and a control device for controlling an amount of air blow from the blowing device in accordance with a position of the recording material discharged by the discharge device.

Further another object of the present invention is to provide an image forming apparatus including: a discharge device for discharging a recording material; a blowing device for blowing air onto a lower surface of the recording material discharged by the discharge device; and a control device for controlling an amount of air blow from the blowing device in accordance with a position of the recording material discharged by the discharge device, in which: the amount of air blow on the trailing edge side is smaller than the amount of air blow on the leading edge side when the recording material is a plain paper; and the amount of air blow on the leading edge side is smaller than the amount of air blow on the trailing edge side when the recording material is a resin sheet.

Still another object of the present invention is to provide an image forming apparatus including: a discharge device for discharging a recording material; a blowing device for blowing on a lower surface of the recording material discharged by the discharge device; and a control device for controlling an amount of air blow by the blowing device in accordance with a position of the recording material discharged by the discharge device, in which: the recording material is a plain paper; and the amount of air blow from the blowing device on a leading edge side of the recording material and the amount of air blow from the blowing device on a trailing edge side of the recording material are different from each other.

Further features of the present invention will become apparent from the following detailed description.

DESCRIPTION OF THE PREFERRED EMBODIMENTS

First Embodiment

Hereinbelow, embodiments of the present invention are explained with reference to the drawings. To begin with, a whole configuration of an image forming apparatus which is an embodiment of the present invention is explained with reference to FIG. 10. In this embodiment, the image forming apparatus is a full color laser beam printer capable of forming a full color image in accordance with image information signals from an external host device such as a personal computer communicably connected to an image forming apparatus body. The image forming apparatus according to this embodiment forms the full color image on a recording material such as a plain paper, an OHT sheet by an electrophotographic process. However, the present invention is not limited to this. That is, the present invention can be implemented in an arbitrary form such as a copying machine or a facsimile machine.

Figure 10:
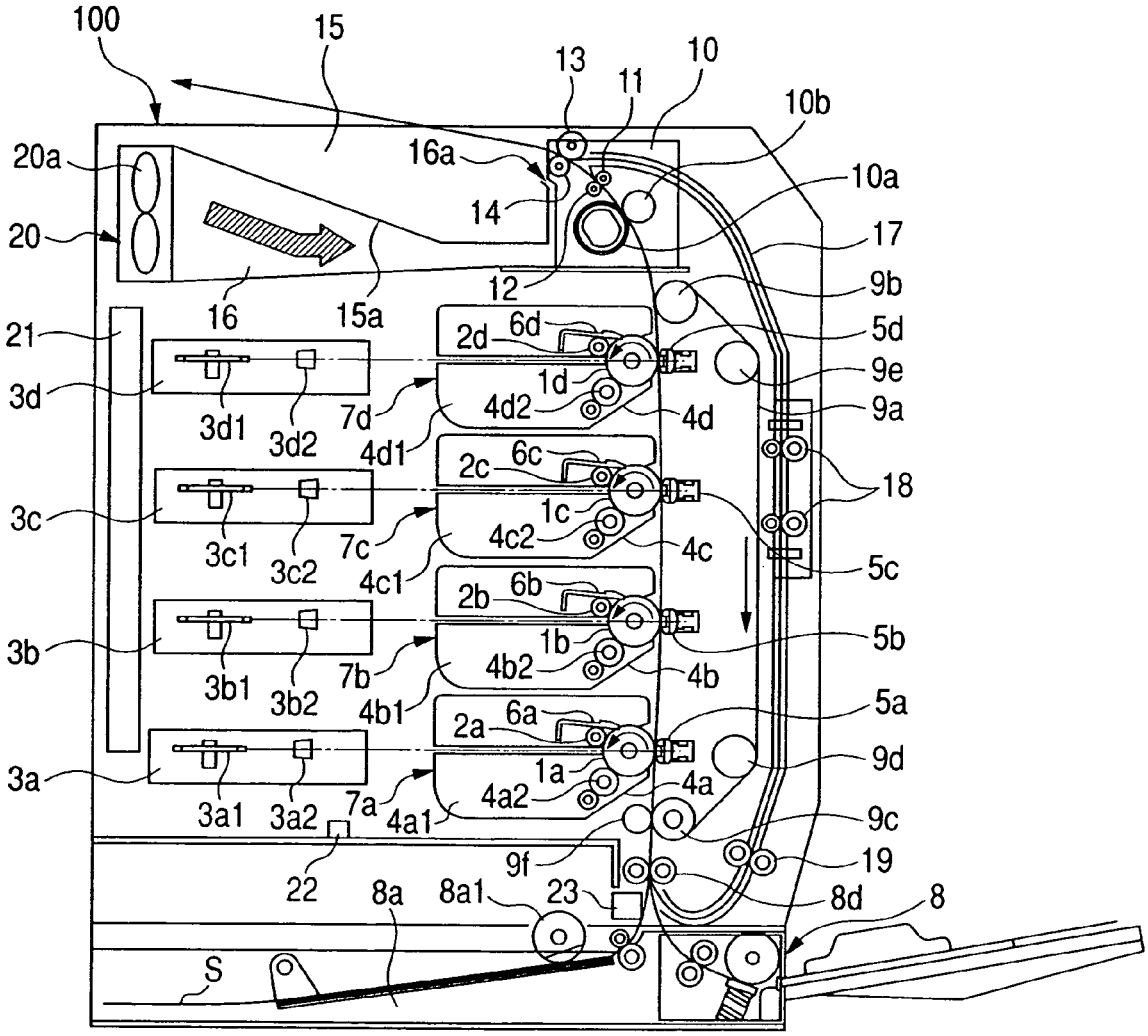
FIG. 10 is a view showing an image forming apparatus which is the embodiment of the present invention.
Figure 11:
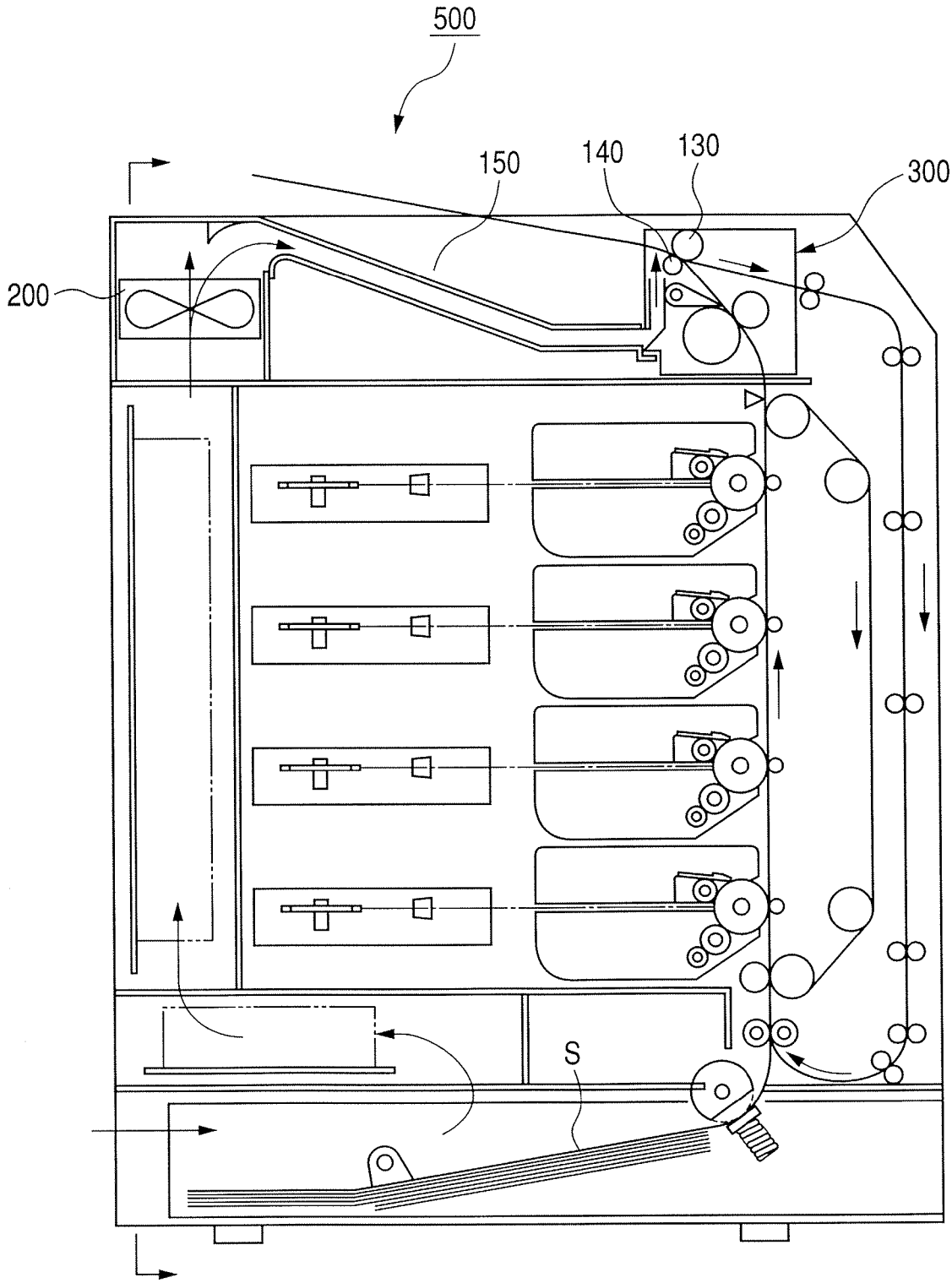
FIG. 11 PRIOR ART
FIG. 11 is a view showing a conventional image forming apparatus.

An image forming apparatus 100 shown in FIG. 10 is provided with four image bearing members in a drum shape disposed in parallel in a substantially perpendicular direction as the image bearing member, namely, a photosensitive drums 1*a*, 1*b*, 1*c*, and 1*d*. The photosensitive drums 1*a*, 1*b*, 1*c*, and 1*d* are rotationally driven in a counterclockwise direction of FIG. 10 by a driving device (not shown).

At the periphery of the photosensitive drums 1*a*, 1*b*, 1*c*, and 1*d*, there are disposed, sequentially along a direction of rotation of the photosensitive drums 1*a*, 1*b*, 1*c*, and 1*d*: electrifying devices 2*a*, 2*b*, 2*c*, and 2*d* for electrifying surfaces of the photosensitive drums 1*a*, 1*b*, 1*c*, and 1*d* in a uniform manner; scanner units 3*a*, 3*b*, 3*c*, and 3*d* for forming electrostatic latent images on the photosensitive drums 1*a*, 1*b*, 1*c*, and 1*d* by irradiating a laser beam on the basis of image information; development devices 4*a*, 4*b*, 4*c*, and 4*d* for developing an electrostatic latent image as a toner image by sticking toner included in a developer to the electrostatic latent image; transfer devices 5*a*, 5*b*, 5*c*, and 5*d* for transferring toner images on the photosensitive drums 1*a*, 1*b*, 1*c*, and 1*d* to a recording material S; cleaning devices 6*a*, 6*b*, 6*c*, and 6*d* for removing toner left after transfer and remaining on the surfaces of the photoreceptor drums 1*a*, 1*b*, 1*c*, and 1*d*; and the like.

In this embodiment, there are provided four image forming sections which are image forming units respectively including: the photosensitive drums 1*a*, 1*b*, 1*c*, and 1*d*; the electrifying devices 2*a*, 2*b*, 2*c*, and 2*d*; the scanner units 3*a*, 3*b*, 3*c*, and 3*d*; the development devices 4*a*, 4*b*, 4*c*, and 4*d*; the cleaning devices 6*a*, 6*b*, 6*c*, and 6*d*; and the like. By each of the four image forming sections, an image of a different color (yellow, cyan, magenta, and black) is formed.

The photosensitive drums 1*a*, 1*b*, 1*c*, and 1*d*; the electrifying devices 2*a*, 2*b*, 2*c*, and 2*d* which are processing units acting on the photosensitive drums 1*a*, 1*b*, 1*c*, and 1*d*; the development devices 4*a*, 4*b*, 4*c*, and 4*d*; and the cleaning devices 6*a*, 6*b*, 6*c*, and 6*d* are configured integrally in a cartridge form. In other words, each of process cartridges 7*a*, 7*b*, 7*c*, and 7*d* is provided with the photosensitive drum, the electrifying device, the development device, and the cleaning device. The process cartridges 7*a*, 7*b*, 7*c*, and 7*d* are attachable and detachable with respect to the image forming apparatus body 100.

Here, in the explanation as made in below, a front side of the image forming apparatus 100 refers to a side on which the process cartridges 7*a*, 7*b*, 7*c*, and 7*d* are inserted into the image forming apparatus 100, namely, a right side of FIG. 10. Further, a left side and a right side of the image forming apparatus 100 refer to the right side and the left side when viewed from the front side of the image forming apparatus 100, respectively. Hereinbelow, each of the elements is explained in detail, beginning from the photosensitive drums 1*a*, 1*b*, 1*c*, and 1*d*.

The photosensitive drums 1*a*, 1*b*, 1*c*, and 1*d* each have such a configuration that an outer peripheral surface of an aluminum cylinder having a diameter of, for example, 30 mm is coated with an organic photo conductive member layer (OPC photosensitive member). Both ends of each of the photosensitive drums 1*a*, 1*b*, 1*c*, and 1*d* are supported by a supporting member so as to be freely rotated. The photosensitive drums 1*a*, 1*b*, 1*c*, and 1*d* are rotationally driven counterclockwise in FIG. 10 by transmitting a driving force to one end of the photosensitive drums 1*a*, 1*b*, 1*c*, and 1*d* from a drive motor (not shown).

As the electrifying devices 2*a*, 2*b*, 2*c*, and 2*d*, there can be used a contact charge type electrifying member. The electrifying member is an electro-conductive roller formed in a roller shape. The electrifying member evenly electrifies the surfaces of the photosensitive drums 1*a*, 1*b*, 1*c*, and 1*d* by abutting the electro-conductive roller on the surfaces of the photosensitive drums 1*a*, 1*b*, 1*c*, and 1*d* and applying an electrified bias voltage to the electro-conductive roller.

The scanner units 3*a*, 3*b*, 3*c*, and 3*d* are disposed in a substantially horizontal direction of the photosensitive drums 1*a*, 1*b*, 1*c*, and 1*d*. Further, an image light emitted from a laser diode (not shown) corresponding to an image signal enters polygon mirrors 3*a*1, 3*b*1, 3*c*1, and 3*d*1 which are rotated at a high speed by a scanner motor (not shown). The image light reflected on the polygon mirrors 3*a*1, 3*b*1, 3*c*1, and 3*d*1 selectively exposes the surface of the photosensitive drums 1*a*, 1*b*, 1*c*, and 1*d* electrified via imaging lenses 3*a*2, 3*b*2, 3*c*2, and 3*d*2 to form an electrostatic latent image.

The development devices 4*a*, 4*b*, 4*c*, and 4*d* are respectively provided with toner containers 4*a*1, 4*b*1, 4*c*1, and 4*d*1 which respectively contain the colors of yellow, cyan, magenta, and black. The toners in the toner containers 4*a*1, 4*b*1, 4*c*1, and 4*d*1 are respectively fed onto development rollers 4*a*2, 4*b*2, 4*c*2, and 4*d*2 by a toner feeding mechanism (not shown). Then, outer peripheries of the development rollers 4*a*2, 4*b*2, 4*c*2, and 4*d*2 which rotate clockwise in FIG. 10 are each coated with the toner, and an electric charge is imparted to the toner. Then, a developing bias for which an AC voltage and a DC voltage are normally superimposed is applied to each of the development rollers 4*a*2, 4*b*2, 4*c*2, and 4*d*2 opposing the photosensitive drums 1*a*, 1*b*, 1*c*, and 1*d* on which a latent image is formed, respectively. As a result, the toner is supplied to each of the photosensitive drums 1*a*, 1*b*, 1*c*, and 1*d* in accordance with the latent image.

An electrostatic transfer belt (transfer belt) 9*a* which is circulated and is a recording material conveying member is disposed so as to oppose and be in contact with all of the photosensitive drums 1*a*, 1*b*, 1*c*, and 1*d*. The transfer belt 9*a* is configured by a film-like member having a volume resistivity of $10^{11}$ to $10^{14}$ Ω·cm and a thickness of about 150 μm. The transfer belt 9*a* is supported by the roller by four shafts in a vertical direction, and is circulated so that the recording material S is in contact with each of the photosensitive drums 1*a*, 1*b*, 1*c*, and 1*d* by electrostatically attracting the recording material S on the outer peripheral surface in the left in FIG. 10. As a result, the recording material S is conveyed to a transfer position by the transfer belt 9*a* and the toner image on each of the photosensitive drums 1*a*, 1*b*, 1*c*, and 1*d* is transferred on the recording material S.

At a position at which the transfer rollers 5*a*, 5*b*, 5*c*, and 5*d* abut on an inside of the transfer belt 9*a* and oppose each of the four photosensitive drums 1*a*, 1*b*, 1*c*, and 1*d* (the transfer position), the transfer devices 5*a*, 5*b*, 5*c*, and 5*d* are arranged in parallel. A positive-polarity electric charge is applied to the recording material S from each of the transfer rollers 5*a*, 5*b*, 5*c*, and 5*d* via the transfer belt 9*a*. By an electric field formed by this charge, a negative-polarity toner image formed on the photosensitive drums 1*a*, 1*b*, 1*c*, and 1*d* is transferred to the recording material S which is being in contact with the photosensitive drums 1*a*, 1*b*, 1*c*, and 1*d*. The transfer belt 9*a* is also an image conveyance member for bearing and conveying the recording material S on which the toner image formed on each of the photosensitive drums 1*a*, 1*b*, 1*c*, and 1*d* is transferred.

In this embodiment, the transfer belt 9*a* is the belt having a perimeter of 675 mm and a thickness of 120 μm. The transfer belt 9*a* is looped around four rollers of a driving roller 9*b*, driven roller 9*c* and 9*d*, and a tension roller 9*e*. Further, a driving roller 9*b* is rotationally driven by a drive motor (not shown) which is an image conveyance member driving device, thereby rotating the transfer belt 9*a* in a direction indicated by an arrow in FIG. 10. The toner image is transferred to the recording material S while the transfer belt 9*a* is circulated and the recording material S is conveyed from a side of the driven roller 9*c* to a side of the driving roller 9*b*.

A sheet feed section 8 feeds and conveys the recording material S to the image forming section. A plurality of the recording materials S are stored in a paper feed cassette 8*a*. At the time of image forming, a sheet feed roller (semicircular roller) 8*a*1 and a pair of registration rollers 8*d* are rotationally driven in accordance with an image forming operation, and the recording materials S in the paper feed cassette 8*a* are separately fed sheet by sheet. After that, a leading edge of the recording material S is abutted on the pair of registration rollers 8*d* to temporarily stop thereat and a loop is formed on the sheet. After that, the rotation of the transfer belt 9*a* is synchronized with an image writing position, and the recording material S is fed to the transfer belt 9*a* by the pair of registration rollers 8*d*.

A fixing section 10, which is a fixing device, fixes the toner image of a plurality of colors transferred to the recording material S. The fixing section 10 is configured by a heat roller 10*a* which rotates and a pressurizing roller 10*b* which comes into pressure contact with the heat roller 10*a* and pressurizes the recording material S. In other words, the recording material S to which the toner image formed on the photosensitive drums 1*a*, 1*b*, 1*c*, and 1*d* is transferred is conveyed by a pair of fixing rollers 10*a* and 10*b* when the recording material S passes through the fixing section 10 and is also imparted with heat and pressure by the pair of fixing rollers 10*a* and 10*b*. As a result, the toner image of a plurality of colors is fixed on the surface of the recording material S.

Next, an operation of the image forming apparatus 100 with the configuration described above is explained. In the image forming apparatus 100, each of the process cartridges 7*a*, 7*b*, 7*c*, and 7*d* is serially driven in accordance with a timing of image formation, and each of the photosensitive drums 1*a*, 1*b*, 1*c*, and 1*d* is rotationally driven in a counterclockwise direction in FIG. 10 in accordance with the driving of the process cartridges 7*a*, 7*b*, 7*c*, and 7*d*. In addition, the scanner units 3*a*, 3*b*, 3*c*, and 3*d* respectively corresponding to the process cartridges 7*a*, 7*b*, 7*c*, and 7*d* are serially driven. By the driving, the electrifying devices 2*a*, 2*b*, 2*c*, and 2*d* each impart a uniform electric charge on peripheral surfaces of the photosensitive drums 1*a*, 1*b*, 1*c*, and 1*d*, respectively, and the scanner units 3*a*, 3*b*, 3*c*, and 3*d* each carry out an exposure on the peripheral surfaces of the photosensitive drums 1*a*, 1*b*, 1*c*, and 1*d* in accordance with image signals, thereby forming the electrostatic latent image on the peripheral surfaces of the photosensitive drums 1*a*, 1*b*, 1*c*, and 1*d*. The development rollers 4*a*2, 4*b*2, 4*c*2, and 4*d*2 in the development devices 4*a*, 4*b*, 4*c*, and 4*d* transfer the toner to a low potential portion of the electrostatic latent image and form (expose) the toner image on the peripheral surfaces of the photosensitive drums 1*a*, 1*b*, 1*c*, and 1*d*. The pair of registration rollers 8*d* begins to rotate so that the timing at which the leading edge of the toner image formed on the peripheral surface of the photosensitive drums 1*a* which is disposed most upstream among the photosensitive drums 1*a*, 1*b*, 1*c*, and 1*d* is rotationally conveyed to the opposing point at which the photosensitive drums 1*a* is opposed to the transfer belt 9*a* (transfer position) and the timing at which a position at which the image formation of the recording material S begins is conveyed to the opposing point are synchronized, thereby feeding the recording material S to the transfer belt 9*a*.

The recording material S is in pressured contact with the outer peripheral surface of the transfer belt 9*a* by being held between an electrostatic attraction roller 9*f* and the transfer belt 9*a*. In addition, the electric charge is induced to the recording material S which is a dielectric material and to a dielectric layer of the transfer belt 9*a* by applying a voltage between the transfer belt 9*a* and the electrostatic attraction roller 9*f*, thereby electrostatically attracting the recording material S to the outer peripheral surface of the transfer belt 9*a*. As a result, the recording material S is steadily attracted to the transfer belt 9*a* and is conveyed to the most downstream transfer position. While the recording material S is thus conveyed by the transfer belt 9*a*, the toner image on each of the photosensitive drums 1*a*, 1*b*, 1*c*, and 1*d* is serially transferred on the recording material S by the electric field formed respectively between the photosensitive drums 1*a*, 1*b*, 1*c*, and 1*d* and each of the transfer devices 5*a*, 5*b*, 5*c*, and 5*d*.

The recording material S on which the toner image of four colors is transferred changes its direction while being separated from the transfer belt 9*a* in accordance with a curvature of the driving roller 9*b*, and is conveyed into the fixing section 10. The recording material S is, after the toner image is heat fixed by the fixing section 10 on the recording material S, discharged to a sheet discharging section 15 disposed to an outside of the image forming apparatus 100 by a pair of sheet discharging rollers (conveyance rollers) 13 and 14 which is a discharge device in a state in which the image surface side of the recording material S faces down. In a case of both side printing, the recording material S is conveyed to a duplex transport path 17 by reversely rotating the sheet discharging rollers 13 and 14 before the toner image is fixed to the recording material S by the fixing section 10 and the recording material S is completely discharged by the sheet discharging rollers 13 and 14. The recording material S conveyed to the duplex transport path 17 passes through a skew roller 18 disposed at the front portion of the image forming apparatus body, is conveyed vertically downward to reach a U-turn roller 19, and is again conveyed to the image forming section by the U-turn roller 19 and the pair of registration rollers 8*d*.

Figure 1:
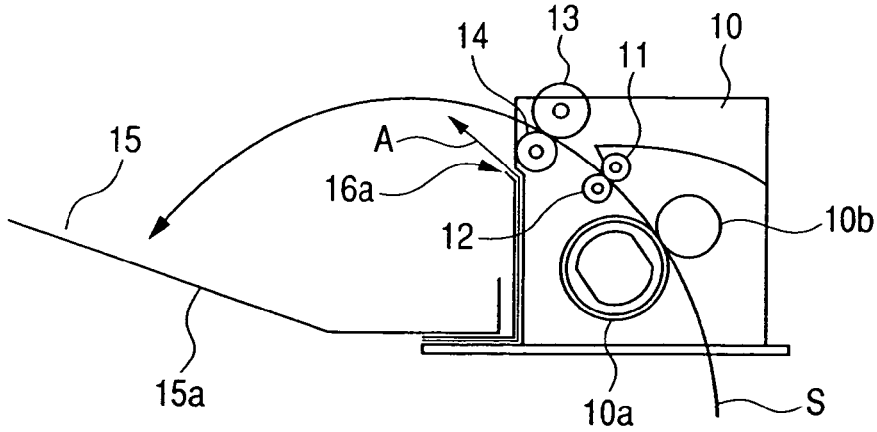
FIG. 1 is a view explaining a sheet discharging section of an image forming apparatus which is an embodiment of the present invention.
Figure 13A:
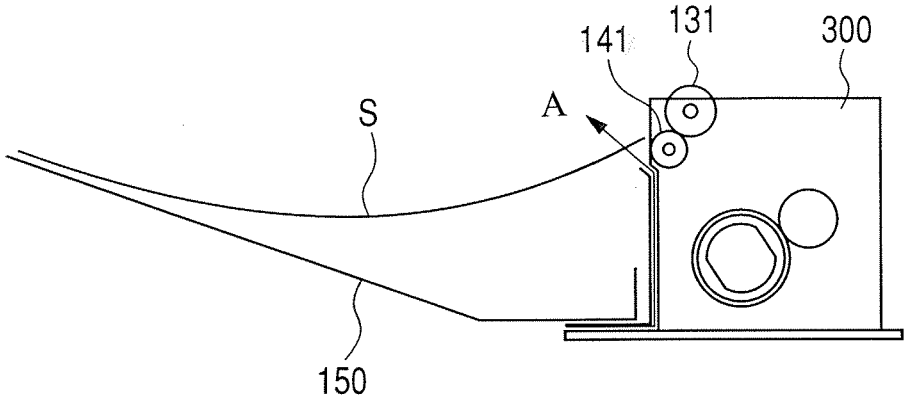
FIGS. 13A and 13B are views each showing a sheet discharging section which is a background art of the present invention.
Figure 13B:
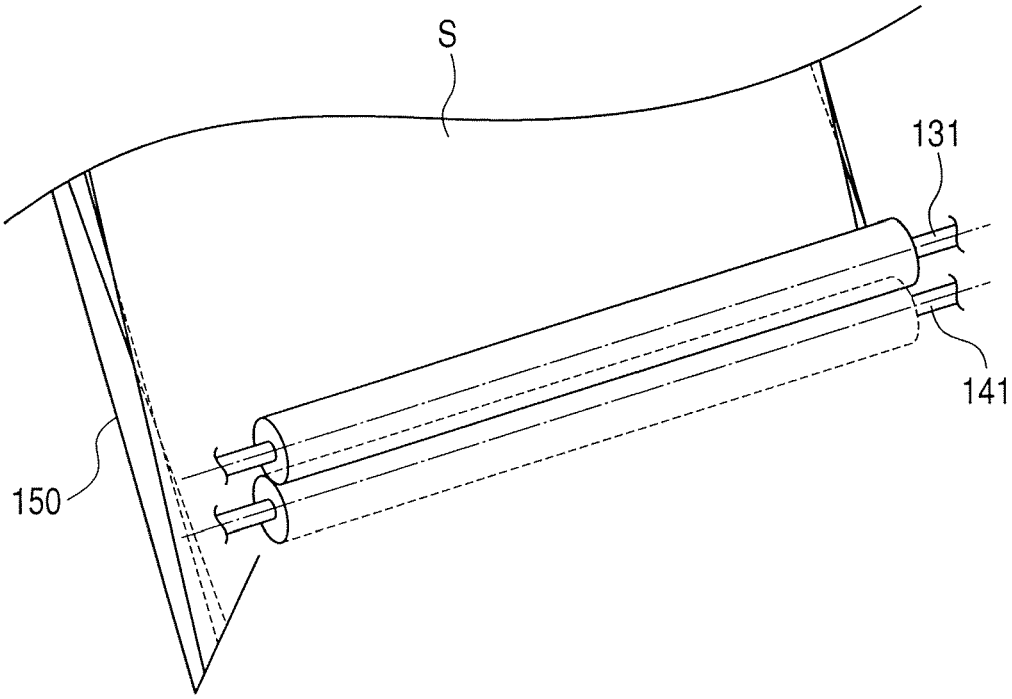

Next, a vicinity of the sheet discharging section of this embodiment is explained in detail. As shown in FIG. 1, on a downstream side of a direction of conveyance of the recording material S which is subjected to fixing action by a heating member 10*a* and a pressurizing member 10*b*, there are provided a pair of conveyance rollers 11 and 12 and the pair of conveyance rollers 13 and 14. The pair of conveyance rollers 13 and 14 is a pair of straight through rollers which comes into contact with the substantially entire width of a image region of the recording material S so that an image failure such as a roller mark on the image or rippling of an OHT sheet is prevented (see FIG. 13B). Note that at least one roller of the pair of conveyance rollers 13 and 14 may be a straight through roller which comes into contact with the substantially entire width of the image region of the recording material S.

A control device 21 (see FIG. 10) for controlling a blowing device 20 controls the blowing device 20 in accordance with an amount of conveyance of the recording material S by the pair of conveyance rollers 13 and 14. In other words, the control device 21 controls an amount of air blow from the blowing device in accordance with the position of the recording material S discharged by the discharge device. An air discharge port 16*a*, which is a discharge section for discharging air blown from the blowing device 20, is disposed below the pair of conveyance rollers 13 and 14. The air discharge port 16*a* blows air onto the lower surface of the recording material S discharged to the sheet discharging section 15 in a direction indicated by an arrow A in FIG. 1. That is, the blowing device 20 is provided with a fan 20*a*, an air duct 16, and the air discharge port 16*a*. Further, the air from the fan 20*a* passes through the air duct 16 and reaches the air discharge port 16*a*, and the air is blown substantially in a direction of movement of the recording material S discharged by the pair of conveyance rollers 13 and 14 by means of the air A from the air discharge port 16*a*.

In this regard, first, a control of the blowing device at the time of discharging a first recording material such as a thin paper or the plain paper as the recording material S is explained in detail.

Figure 2A:
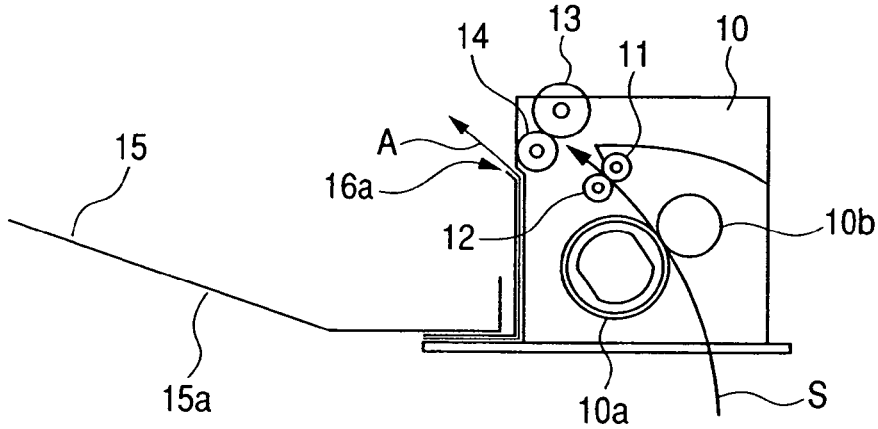
FIGS. 2A and 2B are views each explaining an amount of air blow at the time of discharging a leading edge of a thin paper and a plain paper.
Figure 2B:
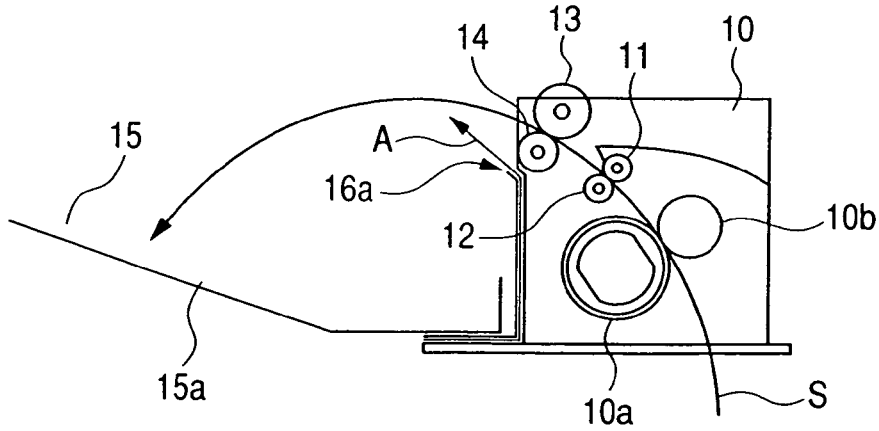

As shown in FIG. 2A, when the thin paper or the plain paper is discharged, the fan 20*a* of the blowing device 20 begins to rotate before the leading edge of the paper reaches the pair of conveyance rollers 13 and 14, and blows the air A onto the lower surface of the leading edge of the conveyed paper with an amount more than a prescribed amount. Then, as shown in FIG. 2B, curl of paper (turning over of paper) in the sheet discharging section 15 is prevented by bringing the leading edge of the paper upward by the air A from the blowing device 20 and conveying the paper to the sheet discharging section 15 by the pair of conveyance rollers 13 and 14.

Here, the thin paper is disadvantageous with regard to prevention of the curl of paper occurring in the sheet discharging section 15 because stiffness of the thin paper is weaker compared to the plain paper. Accordingly, the speed and amount of the air blown onto the lower surface of the paper are set so that the speed is higher and the blowing amount of the air is larger than those of the plain paper. A noise of the fan 20*a* of the blowing device 20 is suppressed at the time of discharging the plain paper by reducing the speed and the amount of the air at the time of discharging the plain paper compared to the case of the thin paper.

Figure 3:
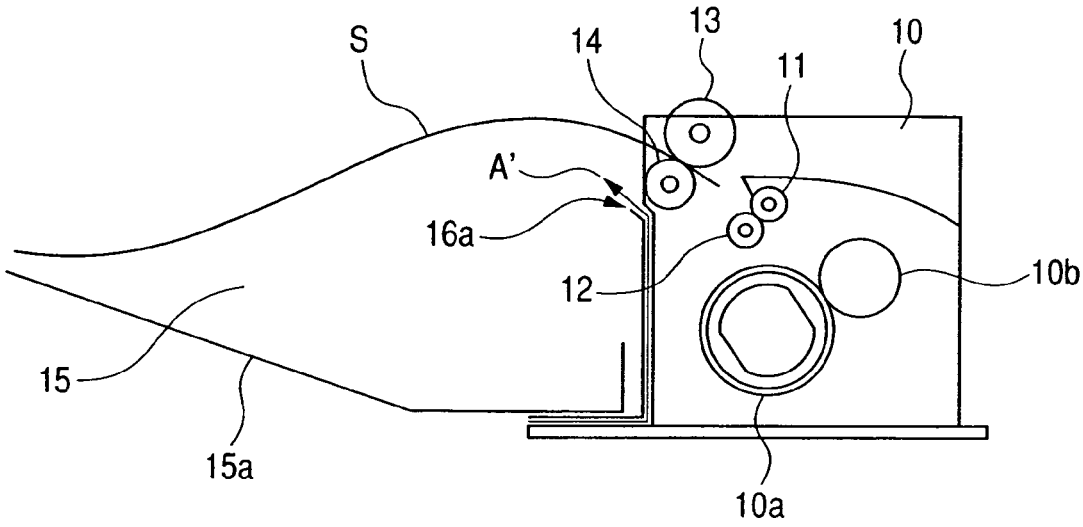
FIG. 3 is a view explaining an amount of air blow at the time of discharging a trailing edge of a thin paper and a plain paper.

Next, as shown in FIG. 3, the control device 21 which controls the blowing device 20 stops power supply for rotationally driving the fan 20*a* before a trailing edge of the thin paper or plain paper passes through the pair of conveyance rollers 13 and 14. At this time, the rotational frequency of the fan 20*a* is gradually reduced. At a moment at which the trailing edge of the paper falls into a sheet discharging tray 15*a*, air A' which is blown onto the lower surface of the paper is set to have the speed and amount of air low enough not to affect the movement of the falling of the trailing edge of the paper into the sheet discharging tray 15*a*. Thus, the trailing edge of the paper steadily falls into the sheet discharging tray 15*a* by a dead weight of the paper.

At this time, if the relatively strong air is blown onto the lower surface of the paper by rotating the fan 20*a* even at the time of falling of the trailing edge of the paper into the sheet discharging tray 15*a*, the air serves as a resistance against the trailing edge of the falling paper. Accordingly, the falling movement of the trailing edge of the paper becomes unsteady. As a result, stacking alignment and stacking capability of the paper in the sheet discharging tray 15*a* are deteriorated.

In this regard, in this embodiment, the control device 21 stops the power supply for rotationally driving the fan 20*a* before the trailing edge of the paper passes through the pair of conveyance rollers 13 and 14. As a result, the air blown onto the lower surface of the paper at the time of falling of the trailing edge of the paper into the sheet discharging tray 15*a* is made to have the speed and amount of air low enough not to affect the falling movement of the trailing edge of the paper into the sheet discharging tray 15*a*. Thus, the falling movement of the trailing edge of the paper into the sheet discharging tray 15*a* is made to be stable, and the stacking alignment and the stacking capability are improved.

In other words, in this embodiment, the amount of air blow from the blowing device 20 on the side of the leading edge of the recording material S is different from the amount of air blow from the blowing device 20 on the side of the trailing edge of the recording material S. Particularly, in a case where the recording material S is the plain paper, the amount of air blow on the trailing edge of the recording material S is smaller than the amount of air blow on the leading edge of the recording material S.

Figure 4:
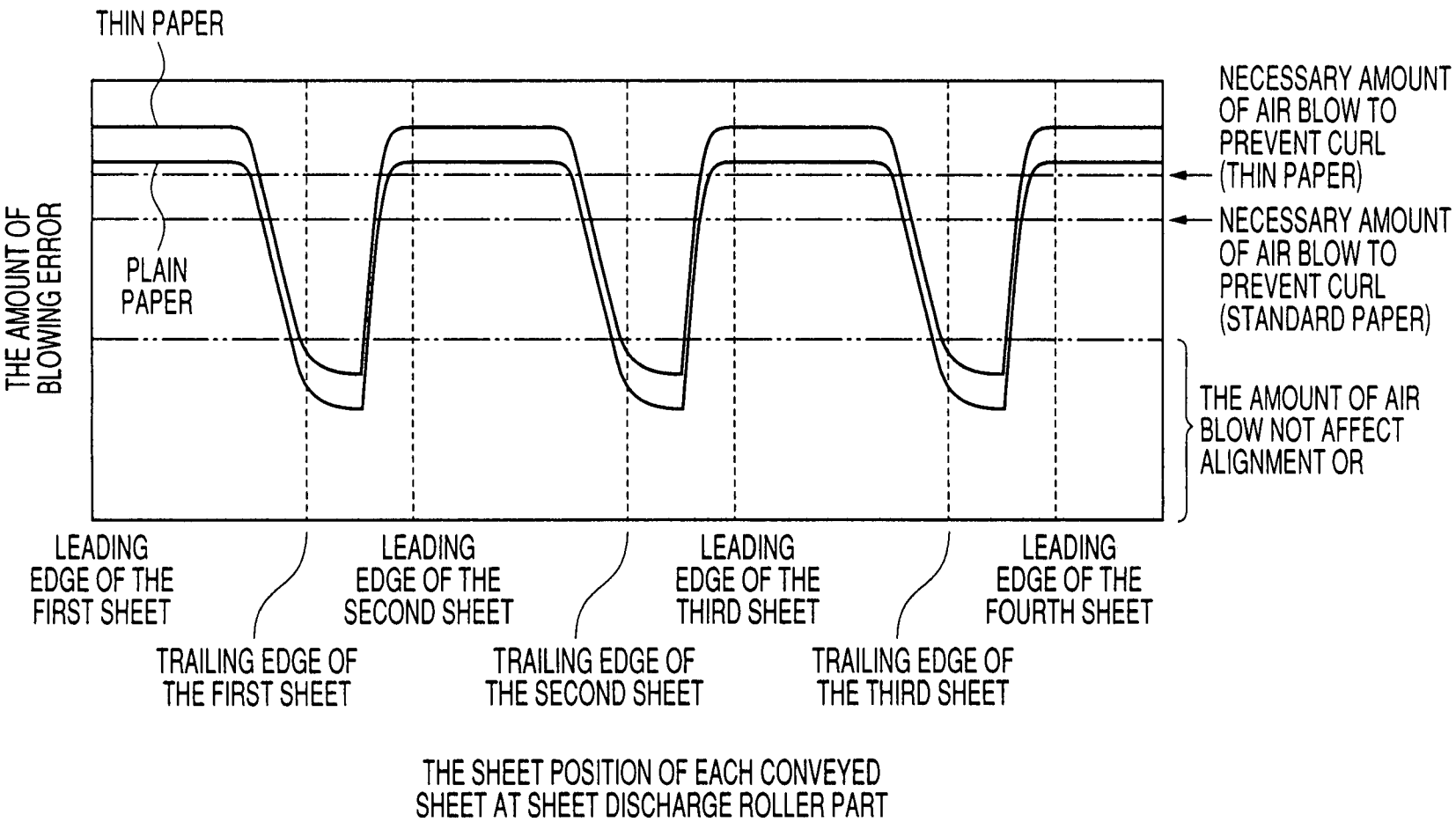
FIG. 4 is a view explaining a control of a fan at the time of continuous discharge of the thin paper and the plain paper.

FIG. 4 is a control diagram showing the blowing device 20 at the time of discharging the thin paper and the plain paper as described above. In a case of continuous paper passage, as shown in FIG. 4, the curl of the paper occurring in the sheet discharging section 15 is prevented with respect to all pieces of paper discharged by repeating the sheet-by-sheet control of the blowing device 20 by means of the control device 21 which controls the blowing device 20, thereby improving the stacking alignment and the stacking capability.

Thus, in this embodiment, the blowing device 20 is controlled in accordance with a discharge amount of the recording material S by the conveyance rollers 13 and 14 (in accordance with the position of the recording material S), thereby making it possible to suppress the curl of the recording material S while the stacking capability of the recording material can be improved.

Next, a control of the blowing device at the time of discharging the OHT sheet which is a second recording material of this embodiment such as a resin sheet is explained in detail.

Figure 5A:
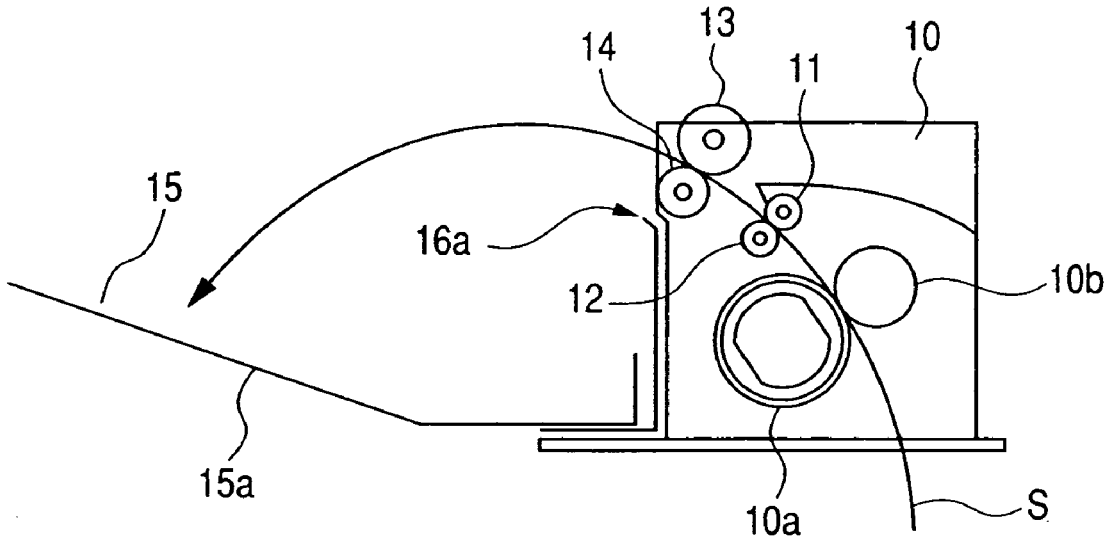
FIGS. 5A and 5B are views each explaining an amount of air blow at the time of discharging of an OHT sheet.
Figure 5B:
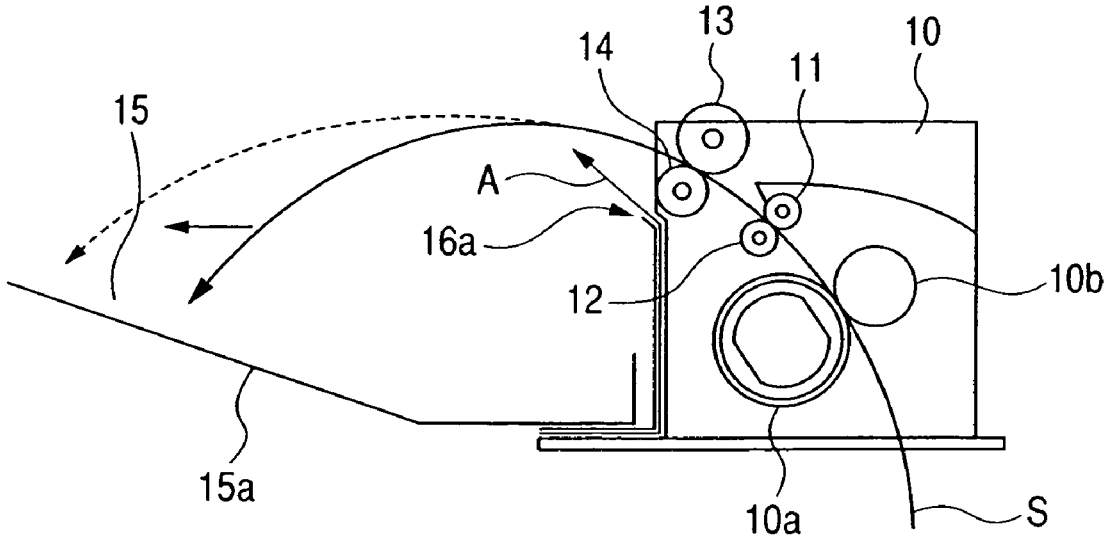

As shown in FIG. 5A, at the time of discharging the OHT sheet, the fan 20*a* of the blowing device 20 is stopped for a prescribed period of time after a leading edge of the OHT sheet has passed through the pair of conveyance rollers 13 and 14, and the air is not blown onto the lower surface of the OHT sheet on the leading edge. As shown in FIG. 5B, the rotation of the fan 20*a* which has been stopped is started immediately before the leading edge of the OHT sheet discharged is brought into contact with the sheet discharging tray 15*a*, and the air indicated by the arrow A is blown onto the lower surface of the OHT sheet. By the air, the leading edge of the OHT sheet is brought upward, and the OHT sheet is conveyed to the sheet discharging section 15 by the pair of conveyance rollers 13 and 14. As a result, the curl of the OHT sheet at the leading edge portion of the OHT sheet occurring in the sheet discharging section 15 due to cooling and solidification of the leading edge portion of the OHT sheet is prevented.

If the rotation of the fan 20*a* is started before the leading edge of the OHT sheet passes through the pair of conveyance rollers 13 and 14, just as in the case of discharging the thin paper or the plain paper, there arises a problem as follows. That is, the leading edge portion of the OHT sheet which is discharged takes a suspended shape before the leading edge portion of the OHT sheet is brought into contact with the sheet discharging tray 15*a*, and if the OHT sheet is cooled in this state, the OHT sheet remains to be in the suspended shape. Thus, the curl of the OHT sheet occurs.

In this regard, in this embodiment, in order to prevent the aforementioned curl from occurring, the fan 20*a* is stopped until the time immediately before the leading edge of the OHT sheet is brought into contact with the sheet discharging tray 15*a*, thereby preventing the air from being blown onto the lower surface of the OHT sheet.

Further, as described later, after the leading edge of the OHT sheet has come into contact with the sheet discharging tray 15*a*, the OHT sheet does not take the suspended shape but a relatively straight shape along the shape of the sheet discharging tray 15*a*. Therefore, in this state, the air having a prescribed speed and amount of air blow may be blown onto the lower surface of the OHT sheet, so it is possible to prevent adhesion of the OHT sheet.

Here, a comparison is carried out between the case where the fan is rotated and the air is blown onto the lower surface of the OHT sheet even before the leading edge of the OHT sheet is brought into contact with the sheet discharging tray and the case where the rotation of the fan is being stopped immediately before the leading edge of the OHT sheet comes into contact with the sheet discharging tray. As a result, if the fan 20*a* is being stopped until the time immediately before the leading edge of the OHT sheet comes into contact with the sheet discharging tray 15*a*, as in this embodiment, the amount of curl due to cooling and solidification of the sheet can be reduced by 5 mm.

In addition, because the OHT sheet has a dead weight heavier than those of the thin paper and the plain paper, the trailing edge of the OHT sheet steadily falls into the sheet discharging tray 15*a* even when the air is blown onto the lower surface of the OHT sheet at the time the trailing edge of the OHT sheet is falling into the sheet discharging tray 15*a*. Accordingly, in this embodiment, it is not necessary to stop the fan 20*a* before the trailing edge of the OHT sheet passes through the pair of conveyance rollers 13 and 14 unlike in the case of control of the blowing device 20 at the time of discharging the thin paper and the plain paper. In other words, in this embodiment, the fan 20*a* is stopped after the trailing edge of the OHT sheet falls into the sheet discharging tray 15*a*. Thus, by the control by which the trailing edge of the OHT sheet is stopped after the trailing edge of the OHT sheet falls into the sheet discharging tray 15*a*, it is possible to cool the whole portion of the OHT sheet and to prevent the adhesion of the OHT sheet in the sheet discharging section 15.

That is, in this embodiment, the amount of air blow from the blowing device 20 on the leading edge side of the recording material S is different from the amount of air blow from the blowing device 20 on the trailing edge side of the recording material S. Particularly in the case where the recording material is the OHT sheet, the amount of air blow on the leading edge of the recording material is smaller than the amount of air blow on the trailing edge of the recording material.

Figure 6:
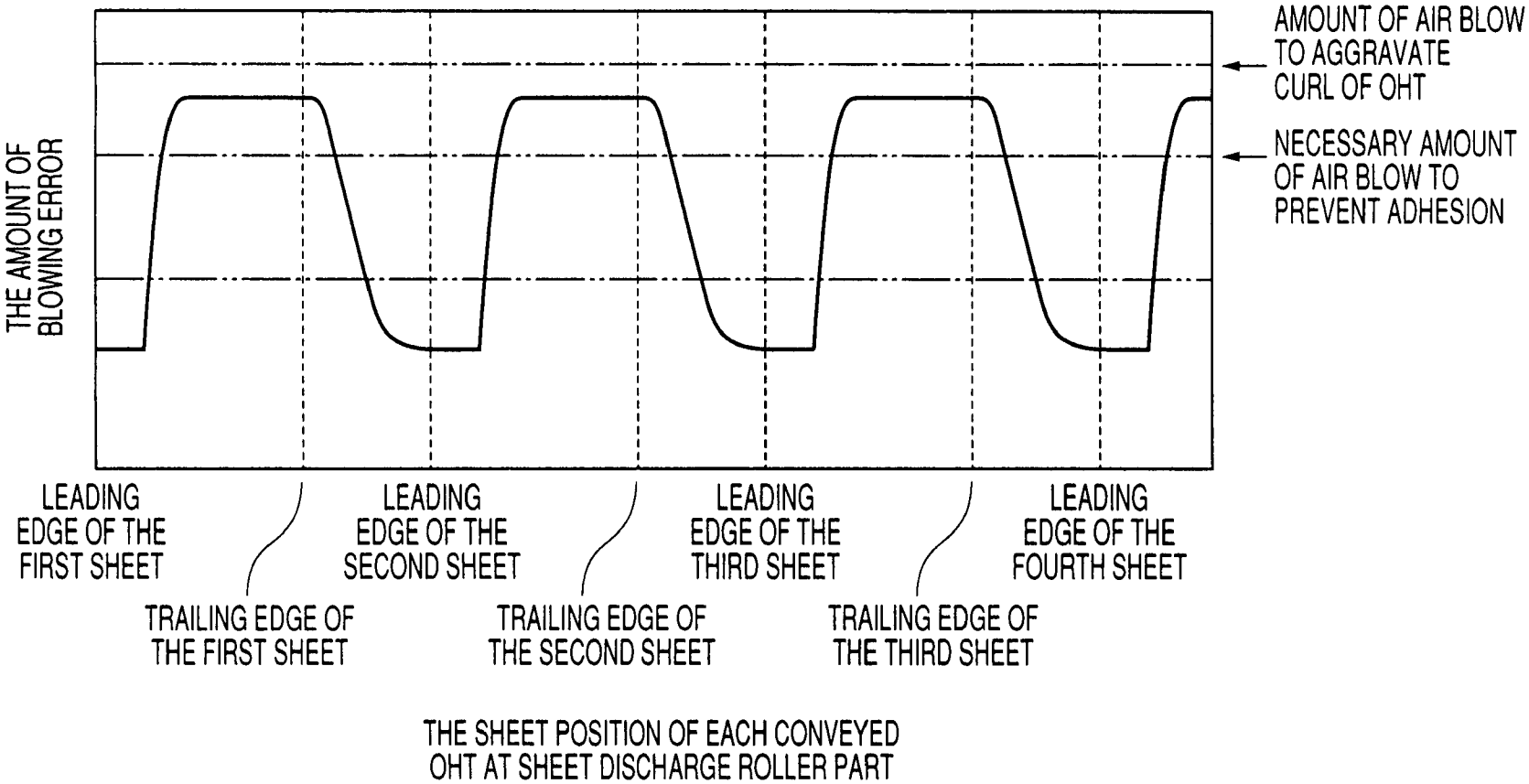
FIG. 6 is a view explaining a control of the fan at the time of continuous discharge of the OHT sheet.

FIG. 6 is a control diagram showing the blowing device 20 at the time of discharging the OHT sheet as described above. In the case of continuous paper passage, the curl of the sheet occurring in the sheet discharging section 15 and the adhesion of the OHT sheet are prevented with respect to all of the OHT sheets discharged by the sheet discharging section 15 by repeating the sheet-by-sheet control of the blowing device 20 in the same manner as described above.

Thus, in this embodiment, the blowing device 20 is controlled in accordance with an amount of delivery of the recording material S by the conveyance rollers 13 and 14 (in accordance with the position of the recording material S), thereby making it possible to suppress the curl of the recording material S while the curl of the recording material S can be prevented.

Here, the control of the blowing device 20 when a thick paper is discharged is explained in detail. When the thick paper is discharged, the curl of the paper does not occur in the sheet discharging section 15 since the thick paper itself has good stiffness, so it is sufficient to blow a minimum required amount of air onto the lower surface of the thick paper.

In addition to the minimum required amount of air blown onto the lower surface of the thick paper, the trailing edge of the thick paper falls into the sheet discharging tray 15*a* with a steady movement due to the dead weight of the thick paper itself, so it is not necessary to stop the fan 20*a* at the time of falling of the thick paper into the sheet discharging tray 15*a*. Further, the rpm of the fan 20*a* is the minimum required rpm, so it is possible to minimize the noise from the fan 20*a* itself. The minimum required amount of air has the speed and amount of air blow at which the thick paper is cooled and the temperature inside the image forming apparatus 100 is prevented from rising so that the temperature inside the image forming apparatus 100 is not raised due to the heat applied to the thick paper stacked on the sheet discharging tray 15*a* when the thick paper is continuously passed.

Next, in the image forming apparatus according to this embodiment, an environmental detection device 22 detects the environment in which the image forming apparatus 100 is used, and the control device 21 controls the blowing device 20. That is, even in the case of the plain paper, the stiffness of the recording material S may become weak under the environment with a high temperature of 27° C. or higher and a high humidity of 70% or higher, which may result in occurance of the curl of the plain paper in the sheet discharging section 15.

In this regard, in this embodiment, in a case where the recording material S to be passed is detected to be the plain paper by a recording material detection device 23 (described later) and where the environment is detected to be the high temperature and high humidity environment by the environmental detection device 22, the control for the plain paper is carried out in the same way as in the control of discharging of the thin paper. In other words, in this embodiment, even in the case of the plain paper, under the high temperature and high humidity environment, the air having the speed and amount of air blow higher than those of the air to be blown under a normal environment (at normal temperature and normal humidity) is blown onto the lower surface of the leading edge of the plain paper, thereby preventing the curl of the plain paper in the sheet discharging section 15.

In addition, when the OHT sheet is passed under the high temperature and high humidity environment, the stiffness of the OHT sheet itself also becomes weaker than the stiffness of the OHT sheet under the normal environment, so the curl of the OHT sheet in the sheet discharging section 15 occurs. In this case, under the high temperature and high humidity environment, the OHT sheet does not remain to be in the suspended shape to cause the curl of the OHT sheet even if the leading edge portion of the OHT sheet is cooled as described above.

In this regard, in a case where the recording material detection device 23 detects the OHT sheet and where the environmental detection device 22 detects the high temperature and high humidity environment, the control described below is carried out instead of the above-mentioned control of the blowing device 20 for the OHT sheet. That is, the rotation of the fan 20*a* is started before the leading edge of the OHT sheet passes through the pair of conveyance rollers 13 and 14 and the air of more than the prescribed amount is blown onto the leading edge portion of the OHT sheet. As a result, the curl of the OHT sheet does not occur and it is possible to bring the leading edge of the OHT sheet upward while the OHT sheet is conveyed to the sheet discharging section 15 by the pair of conveyance rollers 13 and 14, thereby making it possible to prevent the curl of the OHT sheet in the sheet discharging section 15.

In other words, in this embodiment, the control of the blowing device 20 is carried out in accordance with the result of detection by the environmental detection device 22.

Figure 7A:
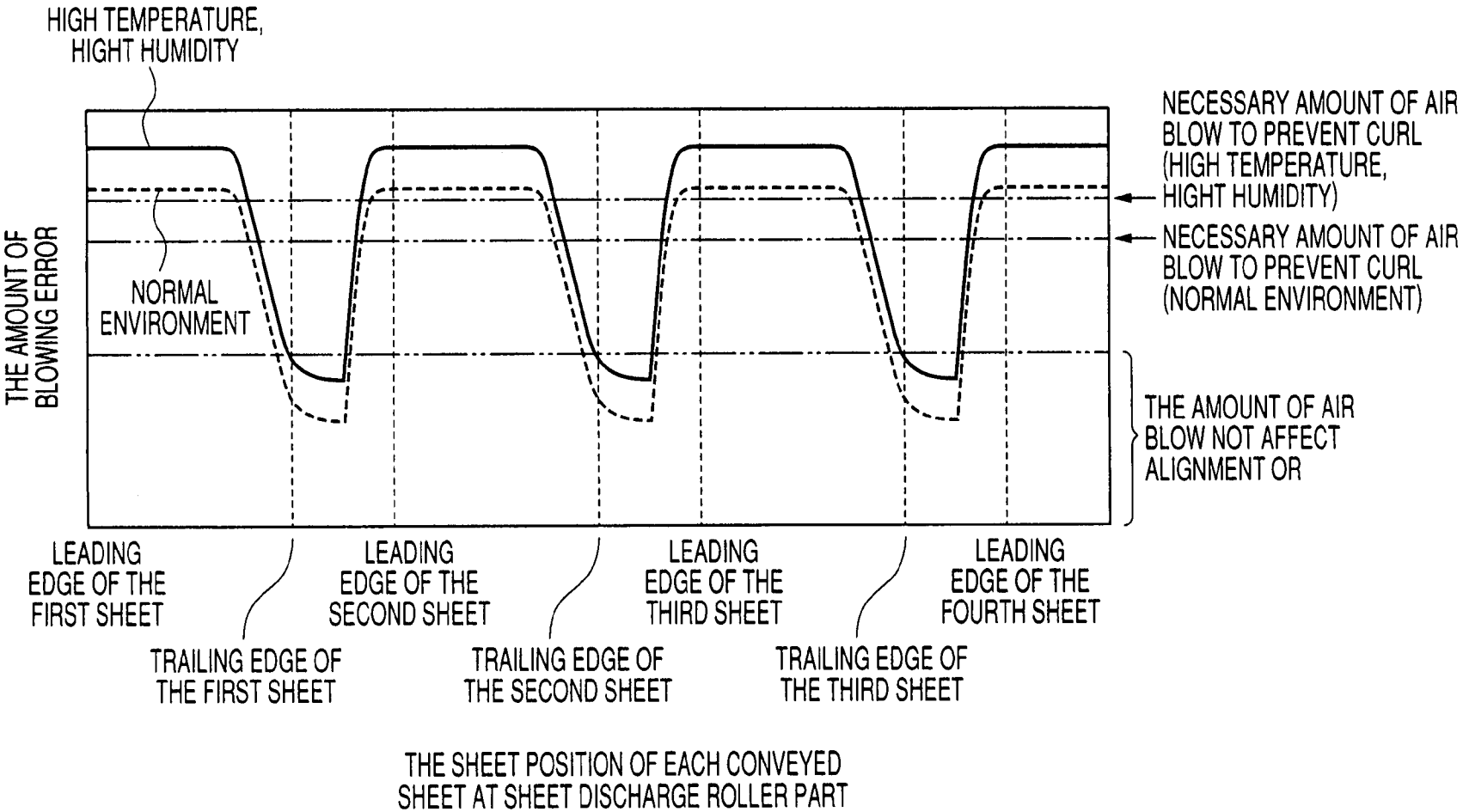
FIGS. 7A and 7B are views each explaining the control of the fan at the time of discharging the plain paper and the OHT sheet under a high temperature and high humidity environment.
Figure 7B:
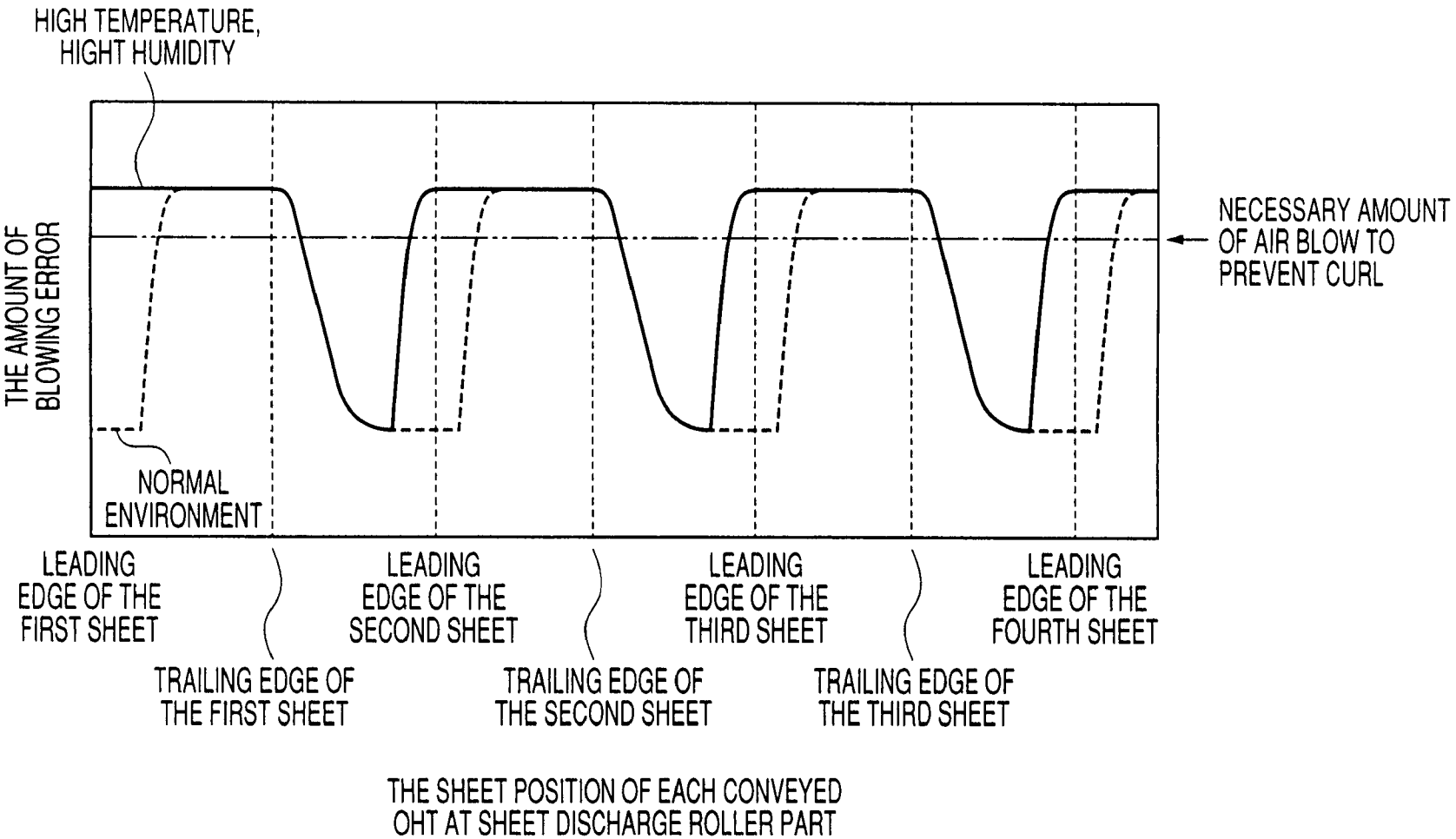

FIG. 7A is a control diagram showing the blowing device 20 in discharging the plain paper under the high temperature and high humidity environment. FIG. 7B is a control diagram showing the blowing device 20 in discharging the OHT sheet under the high temperature and high humidity environment.

In the case of the continuous paper passage, the aforementioned control of the blowing device 20 is repeated sheet by sheet in the same way. As a result, it is possible to prevent the curl of the recording material in the sheet discharging section 15 and the adhesion of the OHT sheet with regard to all of the plain papers and the OHT sheet to be discharged even under the high temperature and high humidity environment.

In the case of a double side paper passage, the recording material S which is fed again into the image forming apparatus 100 is heated by the heat imparted by the fixing section. Thus, the temperature inside the image forming apparatus 100 is raised by the heat. However, in this embodiment, it is possible to suppress the rising of the temperature inside the image forming apparatus 100 by cooling the recording material S by means of the air blown onto the lower surface of the recording material S which is switched back in the sheet discharging section 15 to be fed again, the air being blown in an amount large enough to control the blowing device 20 and cool the recording material S.

The curl of the recording material S in the paper discharging section 15 is prevented by controlling the blowing device 20 to blow onto the lower surface of the leading edge of the recording material S which is discharged to the sheet discharging section 15 after the double side printing is completed. In addition, the stacking alignment and the stacking capability are improved by blowing the air having the speed and amount of air blow which do not effect the stacking alignment and the stacking capability onto the lower surface of the trailing edge of the recording material S.

Figure 8:
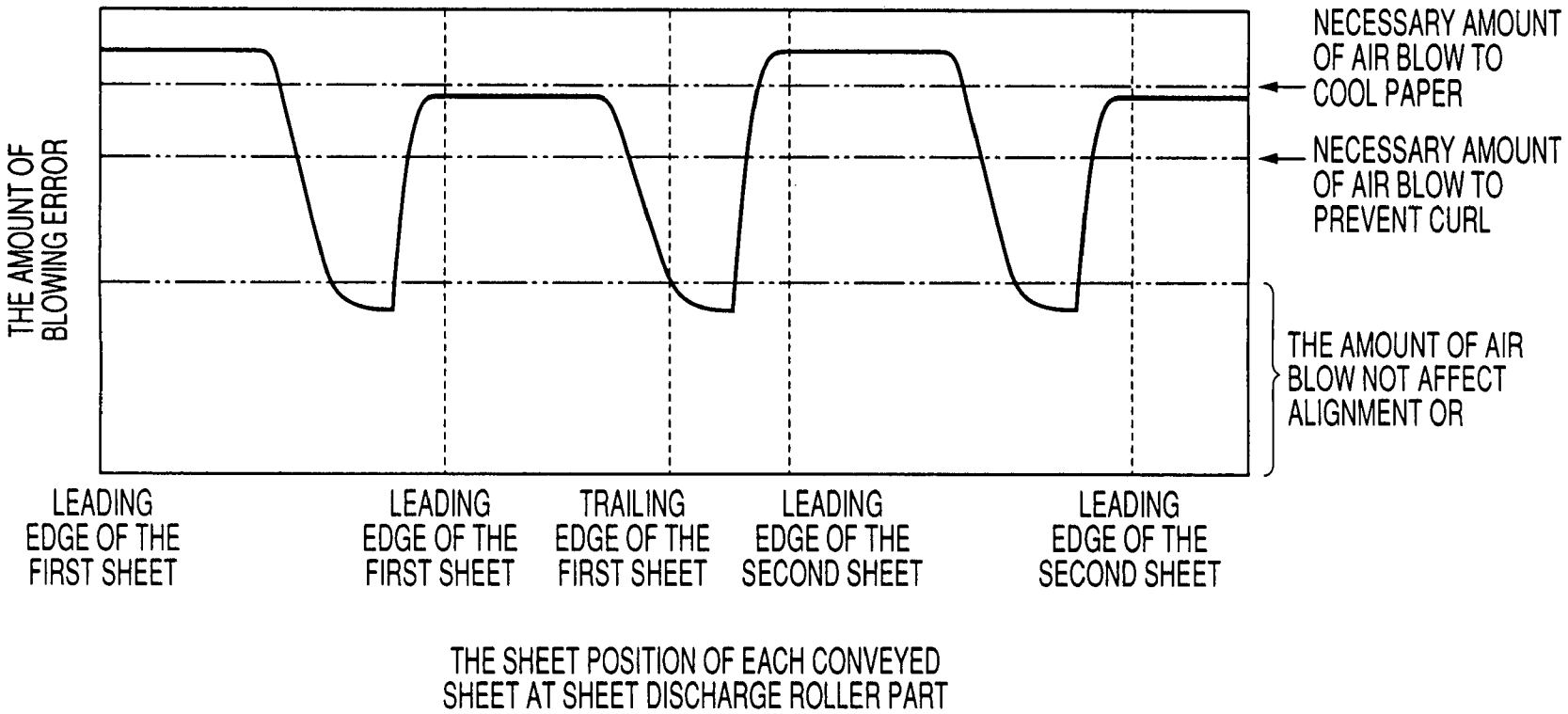
FIG. 8 is a view explaining the fan control at the time of double side paper passage.

FIG. 8 is a control diagram of the blowing device 20 in the case of the aforementioned double side printing.

In the case of the continuous paper passage, by repeating the aforementioned control of the blowing device 20 in the same way sheet by sheet, it is possible to sufficiently cool the recording material S which is fed in again and suppress the rising of the temperature inside the image forming apparatus 100. Further, it is possible to prevent the curl of the recording materials in the sheet discharging section 15 with regard to all of the recording materials S to be discharged, thereby making it possible to improve the stacking alignment and the stacking capability.

Reference symbol 23 denotes the recording material detection device for detecting the kind of the recording material. The control of the blowing device 20 is carried out in accordance with the result of detection of the recording material S by the recording material detection device 23.

The detection as to whether the recording material S to be passed is the thin paper, the plain paper, the thick-paper, the OHT sheet, or the like is carried out by the recording material detection device 23. In accordance with the result of the detection, the control device 21 automatically selects the type of control to control the blowing device 20, and carries out the control in accordance with the sheet sizes of the various kinds.

For example, in a case where the thin paper of a small size is conveyed, when the recording material detection device 23 detects that the paper being passed is the thin paper, the fan 20*a* is rotated before the leading edge of the thin paper passes through the pair of conveyance rollers 13 and 14. Further, it is possible to prevent the curl of the thin paper in the sheet discharging section 15 by blowing the air onto the lower surface of the thin paper on the leading edge and conveying the thin paper to the sheet discharging section 15 by the pair of conveyance rollers 13 and 14. After that, the rotation of the fan 20*a* is stopped in a timing earlier than a timing in the case that a thin paper of a standard size is discharged, and the speed and amount of air blow of the air blown onto the lower surface of the thin paper on the trailing edge are set to be low enough not so as to affect the falling of the thin paper into the sheet discharging tray 15*a*. As a result, the trailing edge of the small size thin paper steadily falls into the sheet discharging tray 15*a*, making it possible to improve the stacking alignment and the stacking capability.

Figure 9:
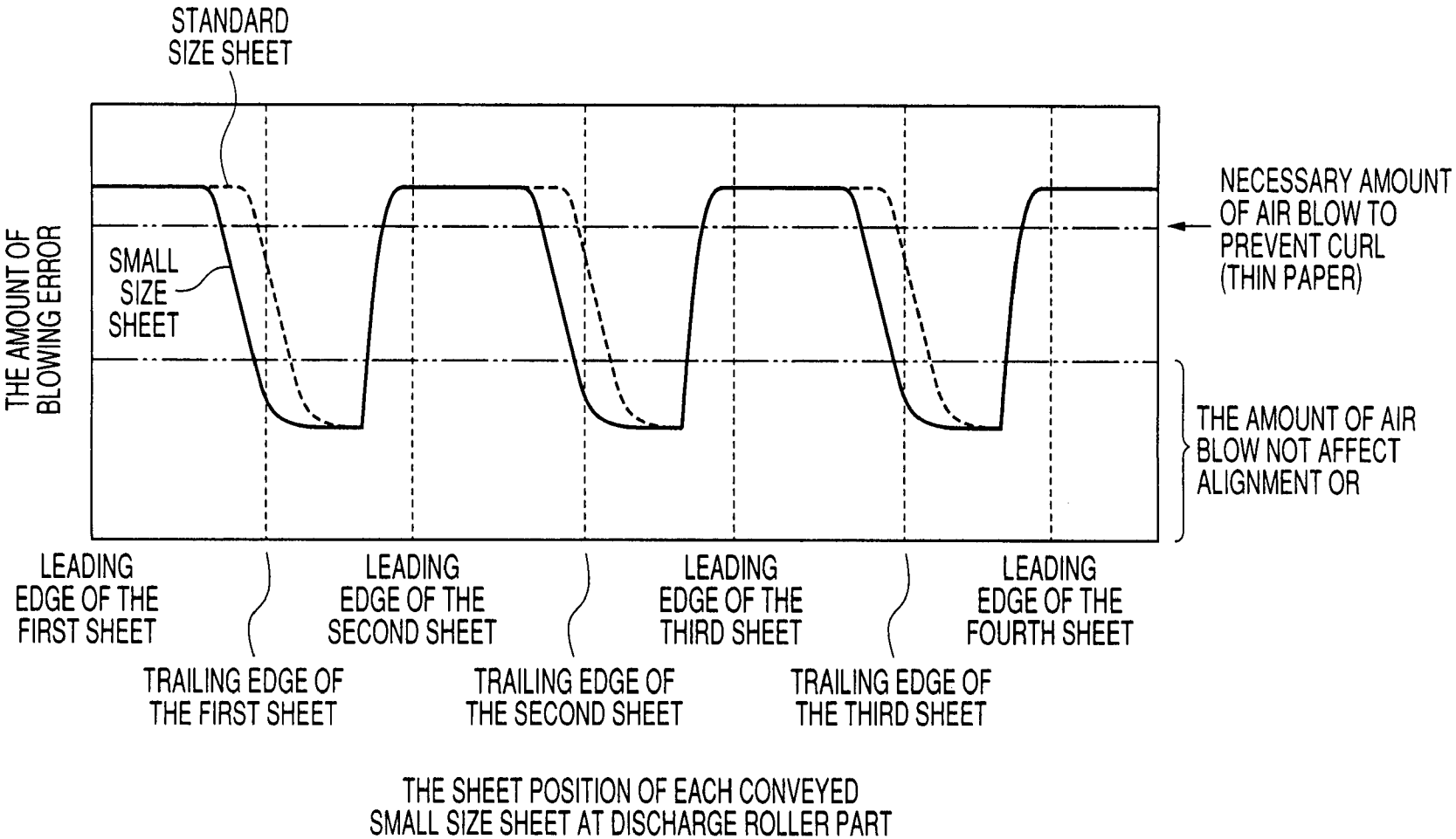
FIG. 9 is a view explaining the fan control at the time of passing a paper of a small size.

FIG. 9 is a control diagram of the blowing device 20 when the small size thin paper is conveyed.

In the case of the continuous paper passage also, it is possible to prevent the curl of the recording material S in the sheet discharging section 15 by carrying out the control of the blowing device 20 in accordance with the kind and size of the recording material S which is conveyed. In addition, the stacking alignment and the stacking capability are improved by blowing the air having the speed and amount of air blow which do not affect the stacking alignment and the stacking capability onto the lower surface of the recording material S on the trailing edge.

In order to bring the leading edge of the OHT sheet, the thin paper or the plain paper slightly upward and convey the thin paper, the plain paper, and the OHT sheet to the downstream side of the sheet discharging section 15, it is preferable that an angle of the air discharge port 16*a* of the air A blown from the fan 20*a* be set to be directed upward with respect to a nip angle (direction of discharge) of the pair of conveyance rollers 13 and 14 by the angle in a range of 0° to 60°.

Here, if the angle of the air discharge port is the angle in a negative direction, the stacking capability of the recording material S which has been stacked is affected and the leading edge of the thin paper, plain paper, and the OHT sheet can not be brought upward, so the leading edge acts as a brake at the time the leading edge is brought into contact with the sheet discharging tray 15*a*. In this case, the curl of the recording material occurs in the sheet discharging section 15. Further, if the angle of the air discharge port is larger than 60°, the leading edge of the thin paper, the plain paper, and the OHT sheet can be brought upward, however, it is difficult to convey the leading edge of the thin paper, the plain paper, and the OHT sheet to the downstream side of the sheet discharging section 15. Thus, the curl of the thin paper, the plain paper, and the OHT sheet occurs in the sheet discharging section 15.

In this regard, in this embodiment, the angle of the air discharge port is set to be upward with respect to the nip angle of the pair of conveyance rollers 13 and 14 within the range of 0° to 60°.

Further, the amount of air blow of the air to be blown onto the thin paper, the plain paper, and the OHT sheet at the time of conveyance of the thin paper, the plain paper, and the OHT sheet is set to be in the range of 0.7 $m^3$/min to 1.2 $m^3$/min. As a result, it is possible to discharge and stack the thin paper, the plain paper, and the OHT sheet without disturbing the stacking of the recording material S which has been discharged to be stacked in the sheet discharging section 15. Here, if the amount of air blow of the air is below 0.7 $m^3$/min, it is not possible to bring the leading edge of the thin paper, the plain paper, and the OHT sheet nor to convey the thin paper, the plain paper, and the OHT sheet to the downstream side of the sheet discharging section 15. Accordingly, the curl of the recording material occurs in the sheet discharging section 15. In addition, if the amount of air blow is larger than 1.2 $m^3$/min, the curl of the OHT sheet gets even worse, so in this embodiment, the amount of air blow at the time of conveyance of the OHT sheet is set to be in the range of 0.7 $m^3$/min to 1.2 $m^3$/min. Note that the measurement of the amount of air blow is carried out by using ATM-24 made by Cambridge AccuSense Inc.

As is described above, in this embodiment, the image forming apparatus with such a configuration that the air is blow onto the lower surface of the recording material, the blowing device is controlled, and the amount of air blow is controlled in accordance with the conveyance amount of the recording material, namely, the position of the recording material.

As a result, it is possible, at the time of conveyance of the thin paper and the plain paper, to prevent the curl of the thin paper and the plain paper in the sheet discharging section and also stabilize the movement of the trailing edge of the thin paper and the plain paper at the time of falling of the thin paper and the plain paper into the sheet discharging section by stopping the fan before the time of falling of the trailing edge of the thin paper and the plain paper into the sheet discharging section, thereby making it possible to improve the stacking alignment and the stacking capability.

Further, at the time of conveyance of the OHT sheet, it is possible to prevent the curl of the OHT sheet due to cooling and solidification of the leading edge of the OHT sheet from occurring by stopping the fan until the time immediately before the leading edge of the OHT sheet comes into contact with the sheet discharging tray. After that, the fan is rotated and the fan is stopped after the OHT sheet falls into the sheet discharging section, thereby making it possible to prevent the adhesion of the OHT sheet.

In addition, the control of the blowing device is changed to the control in accordance with the environment by detecting the environment in which the image forming apparatus is used by the environmental detection device even in the case of the plain paper and the OHT sheet under the high temperature and high humidity environment which is disadvantageous with regard to prevention of the curl of the recording material in the sheet discharging section. As a result, it is possible to prevent the curl of the recording material from occurring.

Further, by detecting with the recording material detection device the kind of the recording material to be conveyed, it is possible to carry out the control in accordance with the recording material, prevent the curl of the recording material in the sheet discharging section, and improve the stacking alignment and the stacking capability. In addition, it is possible to prevent the curl of the leading edge of the OHT sheet and minimize the noise from the fan.

Figure 12:
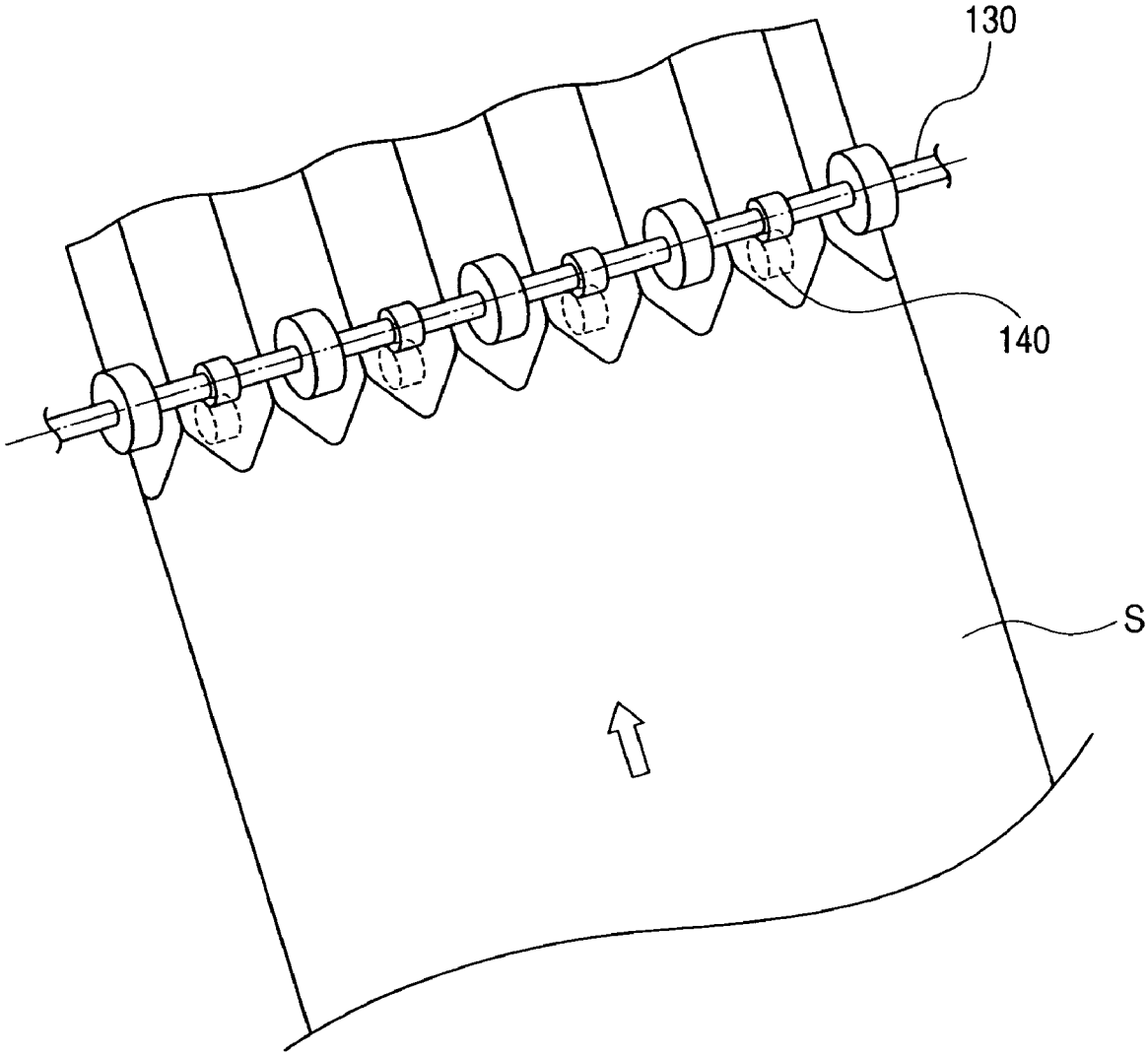
FIG. 12 is a view showing a sheet discharging section which is a background art of the present invention.

Note that in the embodiment as described above, the pair of conveyance rollers is the pair of the straight through rollers at least one roller of which is in contact with the substantially entire width of the image region of the recording material. However, if the rippling does not so affect, the pair of the conveyance rollers may be the group of plural rollers arranged alternately and independent of one another in an axial direction as shown in FIG. 12. In this case, stiffness is added to the recording material, so it is possible to further improve the conveyance of the recording material.

Hereinbefore, the embodiment of the present invention has been explained as described above. However, the present invention is not limited to the above embodiment and can be modified to any form within the scope of technical idea of the present invention.

This application is based on Japanese Patent Application No. 2004-315836 filed Oct. 29, 2004, which is hereby incorporated by reference herein.

What is claimed is:

1. An image forming apparatus comprising:

a fixing device for heat fixing a toner image on a recording material;

a discharge device for discharging the recording material on which the toner image is fixed by the fixing device;

a blowing device for blowing air onto a lower surface of the recording material while the recording material is being discharged by the discharge device; and a control device for controlling an amount of air blown from said blowing device, wherein before a trailing edge of the recording material is discharged by said discharge device after the leading edge has been discharged, the control device changes an amount of air blown according to a position of the recording material discharged by said discharge device.

2. An image forming apparatus according to claim 1, wherein an amount of air blown from said blowing device on a leading edge side of the recording material and an amount of air blown from said blowing device on a trailing edge side of the recording material are different from each other.

3. An image forming apparatus according to claim 2, wherein the amount of air blow on the trailing edge side is smaller than the amount of air blown on the leading edge side in a case that the recording material is a plain paper, and the amount of air blown on the leading edge side is smaller than the amount of air blow on the trailing edge side in a case that the recording material is a resin sheet.

4. An image forming apparatus according to claim 1, further comprising an environmental detection device for detecting an environment, wherein the control device controls the amount of air blown from the blowing device in accordance with a result of detection by the environmental detection device.

5. An image forming apparatus according to claim 1, wherein the blowing device blows air substantially in a direction of movement of the recording material discharged by the discharge device.

6. An image forming apparatus according to claim 1, wherein the discharge device comprises a pair of rollers for conveying the recording material, and at least one of the pair of rollers is in contact with a substantially entire width of an image region of the recording material.

7. An image forming apparatus comprising:

a discharge device for discharging a recording material;

a blowing device for blowing air onto a lower surface of the recording material while the recording material is being discharged by the discharge device; and a control device for controlling an amount of air blown from the blowing device in accordance with a position of the recording material discharged by the discharge device, wherein the amount of air blow on the trailing edge side is smaller than the amount of air blown on the leading edge side in a case that the recording material is a plain paper, and the amount of air blown on the leading edge side is smaller than the amount of air blow on the trailing edge side in a case that the recording material is a resin sheet.

8. An image forming apparatus according to claim 7, further comprising an environmental detection device for detecting an environment, wherein the control device controls the amount of air blown from the blowing device in accordance with a result of detection by the environmental detection device.

9. An image forming apparatus according to claim 7, wherein the blowing device blows air substantially in a direction of movement of the recording material discharged by the discharge device.

10. An image forming apparatus according to claim 7, wherein the discharge device comprises a pair of rollers for conveying the recording material, and at least one of the pair of rollers is in contact with a substantially entire width of an image region of the recording material.

11. An image forming apparatus comprising:

a discharge device for discharging a recording material;

a blowing device for blowing on a lower surface of the recording material while the recording material is being discharged by the discharge device; and a control device for controlling an amount of air blown from the blowing device, wherein the recording material is a plain paper, and before a trailing edge of the recording material is discharged by said discharge device after the leading edge has been discharged, the control device changes an amount of air blown according to a position of the recording material discharged by said discharge device.

12. An image forming apparatus according to claim 11, wherein the amount of air blow on the trailing edge side is smaller than the amount of air blown on the leading edge side.

13. An image forming apparatus according to claim 11, further comprising an environmental detection device for detecting an environment, wherein the control device controls the amount of air blown from the blowing device in accordance with a result of detection by the environmental detection device.

14. An image forming apparatus according to claim 11, wherein the blowing device blows air substantially in a direction of movement of the recording material discharged by the discharge device.

15. An image forming apparatus according to claim 11, wherein the discharge device comprises a pair of rollers for conveying the recording material, and at least one of the pair of rollers is in contact with a substantially entire width of an image region of the recording material.

16. An image forming apparatus according to claim 1, wherein said discharge device has a pair of rollers which pinch the recording material.

17. An image forming apparatus according to claim 11, wherein said discharge device has a pair of rollers which pinch the recording material.

* * * * *

UNITED STATES PATENT AND TRADEMARK OFFICE

CERTIFICATE OF CORRECTION

PATENT NO. : 7,283,776 B2
APPLICATION NO. : 11/252733
DATED : October 16, 2007
INVENTOR(S) : Katsuhiko Oba It is certified that error appears in the above-identified patent and that said Letters Patent is hereby corrected as shown below:

IN THE DRAWINGS:
Sheet No. 3, Figure 4, “AFFECT” should read --AFFECTING--.
Sheet No. 6, Figure 7A, “AFFECT” should read --AFFECTING--.
Sheet No. 7, Figure 7B, “HIGHT” should read --HIGH--.
Sheet No. 8, Figure 8, “AFFECT” should read --AFFECTING--.
Sheet No. 9, Figure 9, “AFFECT” should read --AFFECTING--.

COLUMN 2:
Line 20, “stabled.” should read --stable.--.
Line 47, “blow” should read --blown--.
Line 55, “blow” should read --blown--.
Line 58, “blow” should read --blown--.
Line 59, “blow” should read --blown--.
Line 61, “blow” should read --blown--.
Line 62, “blow” should read --blown--.

COLUMN 3:
Line 2, “blow” should read --blown--.
Line 5, “blow” should read --blown--.
Line 7, “blow” should read --blown--.
Line 19, “blow” should read --blown--.
Line 21, “blow” should read --blown--.
Line 28, “blow” should read --blown--.

COLUMN 4:
Line 6, “a” should be deleted.
Line 46, “in” should be deleted.

COLUMN 8:
Line 2, “blow” should read --blown--.

COLUMN 10:
Line 15, “blow” should read --blown--.
Line 49, “blow” should read --blown--.
Line 51, “blow” should read --blown--.
Line 54, “blow” should read --blown--.
Line 56, “blow” should read --blown--.

UNITED STATES PATENT AND TRADEMARK OFFICE

CERTIFICATE OF CORRECTION

PATENT NO. : 7,283,776 B2
APPLICATION NO. : 11/252733
DATED : October 16, 2007
INVENTOR(S) : Katsuhiko Oba It is certified that error appears in the above-identified patent and that said Letters Patent is hereby corrected as shown below:

COLUMN 11:
Line 48, “blow” should read --blown--.

COLUMN 12:
Line 49, “blow” should read --blown--.

COLUMN 13:
Line 41, “blow” should read --blown--.

COLUMN 14:
Line 5, “blow” should read --blown--.
Line 13, “blow” should read --blown--.
Line 23, “blow” should read --blown--.
Line 27, “blow” should read --blown--.
Line 28, “blow” should read --blown--.

COLUMN 15:
Line 41, “blow” should read --blown--.
Line 45, “blow” should read --blown--.

COLUMN 16:
Line 4, “blow” should read --blown--.
Line 8, “blow” should read --blown--.
Line 41, “blow” should read --blown--.

Signed and Sealed this

Twenty-fourth Day of June, 2008

JON W. DUDAS
*Director of the United States Patent and Trademark Office*